United States Patent [19]

Bloom, Jr.

[11] Patent Number: 5,010,962

[45] Date of Patent: Apr. 30, 1991

[54] INDICATING APPARATUS FOR A COUPLING

[75] Inventor: John J. Bloom, Jr., St. Charles, Ill.

[73] Assignee: Caterpillar Inc., Peoria, Ill.

[21] Appl. No.: 516,367

[22] Filed: Apr. 30, 1990

[51] Int. Cl.[5] ..... A01B 39/20; A01B 51/00; G01D 5/00; G01D 5/02

[52] U.S. Cl. ..... 172/430; 116/281; 116/283; 37/DIG. 19; 172/273; 414/723

[58] Field of Search ..... 172/430, 272, 273, 274; 414/723; 37/DIG. 19, 117.5, 118 A, 141 R; 116/281, 282, 283, DIG. 13

[56] References Cited

U.S. PATENT DOCUMENTS

| | | | |
|---|---|---|---|
| 3,243,066 | 3/1966 | Gardner . | |
| 3,272,274 | 9/1966 | Antolini | 172/273 |
| 3,718,222 | 2/1973 | Foster | 414/723 |
| 3,760,883 | 9/1973 | Birk | 172/273 |
| 3,876,091 | 4/1975 | MacDonald . | |

FOREIGN PATENT DOCUMENTS

| | | | |
|---|---|---|---|
| 3200800 | 7/1983 | Fed. Rep. of Germany | 172/272 |

*Primary Examiner*—Dennis L. Taylor
*Assistant Examiner*—Spencer Warnick
*Attorney, Agent, or Firm*—William C. Perry

[57] ABSTRACT

Certain earthworking vehicles are often provided with the ability to change work implements to enable them to perform a variety of operations. In many instances, the coupling mechanism between the work implement and the frame structure of the vehicle that supports them is designed such that the implements may be mounted and removed quickly. During the mounting of the implement upon the support frame, there is no means by which an operator can be sure that the proper attachment has been achieved. A visual inspection of the mounting apparatus or some sort of testing maneuvering of the support frame is required to be sure the work implement is securely attached.

The mounting apparatus of the present invention provides a means by which a proper coupling between the work implement and the support frame is positively indicated. This indication can only be attained when the respective components are aligned in a manner that will allow a proper attachment.

18 Claims, 4 Drawing Sheets

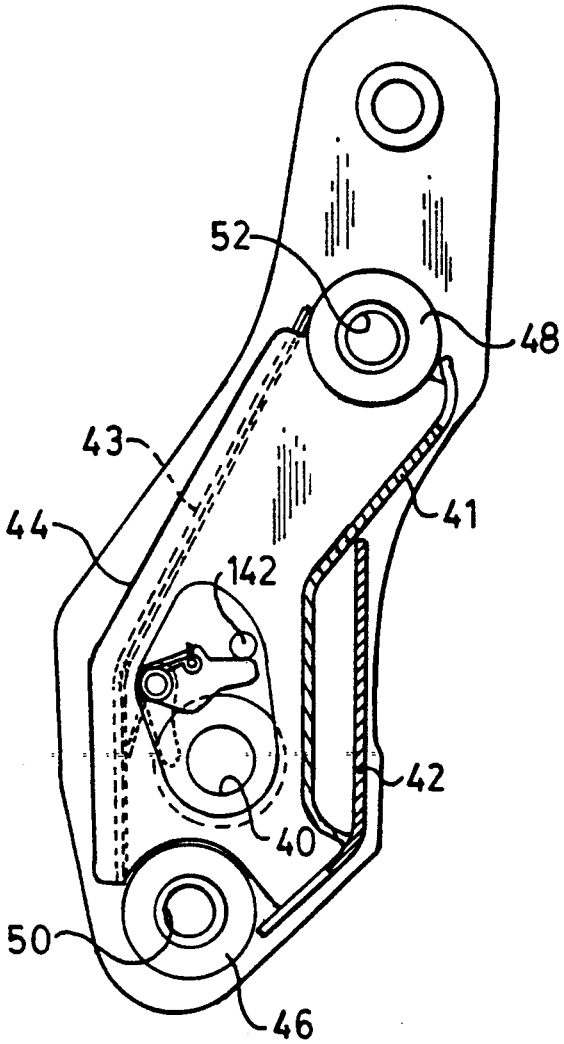
Fig. 3.
Fig. 4.
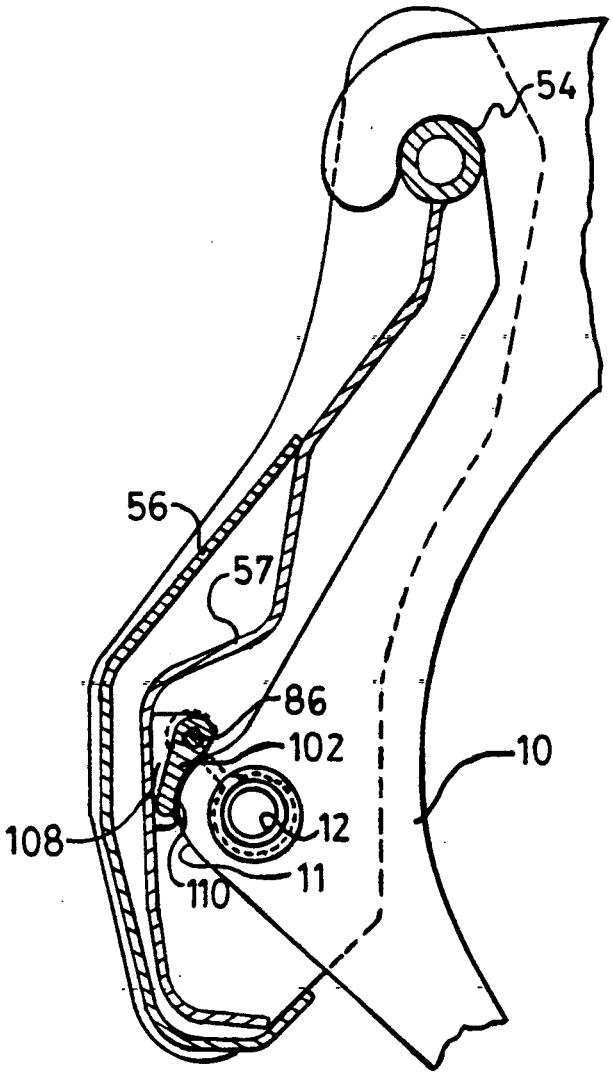

INDICATING APPARATUS FOR A COUPLING

TECHNICAL FIELD

This invention relates generally to a coupling device and more particularly to an apparatus to indicate the coupled condition between two members.

BACKGROUND ART

In the heavy equipment industry there has been a pressing need for versatility in the operation of certain vehicles. This has been accomplished by using a single vehicle for multiple functions. As a result, many different implements have been designed to be coupled to a support frame carried by the lift arms of a vehicle such as a wheel loader. To enhance their versatility even more, a coupling mechanism has been provided that will allow the various implements to be coupled and uncoupled very expediently.

These couplings often have mounted to the support frame, one or more hydraulic cylinders that, when actuated, drive a plurality of mounting pins laterally into aligned bores that exist in both the support frame and work elements. This can most often be accomplished from the cab of the vehicle which is in keeping with the theme of versatility that makes these types of machines so desirable. There are instances however, such as during alignment of the support frame with the implement, that the operator does not have an absolutely clear view of both components. Sometimes the initial contact between the support frame and the implement is done by "feel" and leaves the actual connection of the two elements to the operator's experience. This presents a problem in being able to tell whether or not the bores of the respective elements are properly aligned and whether or not the mounting pins have been properly placed within the aligned bores. Often times the only way to know if a connection has been made is to move the vehicle slightly or perform some initial control functions to be certain that the implement is mounted properly. If a secure coupling has not been achieved then the entire process must be repeated thus negating some of the valuable time saved by the intended versatility of the machine.

A typical coupling apparatus as described above is disclosed in U.S. Pat. No. 3,272,264 issued to H. S. Antolini on Sept. 13, 1966. The patent discloses a latching arrangement between a frame and an earthworking tool that incorporates a plurality of mounting pins that are mounted within the frame. The pins are aligned with bores formed in the tool and upon actuation of a single hydraulic cylinder, the pins are driven laterally by a linkage arrangement to engage the bores of the tool and secure it to the frame. There is no indication upon actuation of the cylinder whether or not the mounting pins properly engaged the bores of the tool.

Another coupling apparatus is disclosed in U.S. Pat. No. 3,876,091, issued to Raymore D. MacDonald on Apr. 8, 1975. This patent also discloses a plurality of mounting pins that are mounted within a framework that is supported on the ends of a pair of lift arms of a vehicle. The mounting pins are extended laterally into aligned openings formed in a work implement upon actuation of a centrally mounted lever. While the position of the lever may serve as an indication as to whether or not the pins have been laterally displaced, there is no indication that the pins have been seated properly within the bores.

Another coupling apparatus that is similar to those previously described is disclosed in U.S. Pat. No. 3,760,883 issued to Billy D. Birk on Sept. 25, 1973. This patent also discloses a plurality of laterally extendable pins that are mounted to a support frame that engage aligned bores of a work implement to achieve coupling thereof to the support frame. This patent also fails to disclose a means to indicate the position of the pins or their relationship with respect to the work implement.

Yet another coupling means for loader attachments is disclosed in U.S. Pat. No. 3,243,066, issued to C. W. Gardner et al on Mar. 29, 1966. This patent also discloses a plurality of mounting pins that are mounted to a support frame and extend laterally into aligned mounting holes of an attachment. A means is provided that visually indicates that the pins have moved to their extended position however the indicating means does not indicate whether or not a proper coupling between the support frame and the attachment has been achieved.

The present invention is directed to overcoming one or more of the problems as set forth above.

DISCLOSURE OF THE INVENTION

In one aspect of the present invention an apparatus for indicating the coupled condition between a first and second member is provided. The first member has an opening formed therein and the second member has a pin moveable into the opening to couple the respective members together. A means for establishing contact between the first and second members when said members are in a position to be coupled together is positioned between the first and second members. A means for indicating the movement of the pin into the opening of the first member is also provided and is operable when contact between the first and second members has been established.

By utilizing a device as set forth above, for instance in an application involving a vehicle and a work implement, an operator may quickly and positively determine when a coupling between the two components has been achieved. The indicating apparatus is such that it may be seen by the operator only when the first and second members are in proper position with respect to each other to be coupled together and only when the mounting pin has been advanced into its proper mounting position. In this way, the uncertainty as to whether or not a proper coupling has been achieved may be eliminated.

BRIEF DESCRIPTION OF THE DRAWINGS

FIG. 3 is an diagrammatic cross-sectional view of the mounting frame as viewed along lines 3—3 of FIG. 2;

FIG. 4 is a diagrammatic cross-sectional view of the mounting frame as viewed along lines 4—4 of FIG. 2;

BEST MODE FOR CARRYING OUT THE INVENTION

Figure 1:
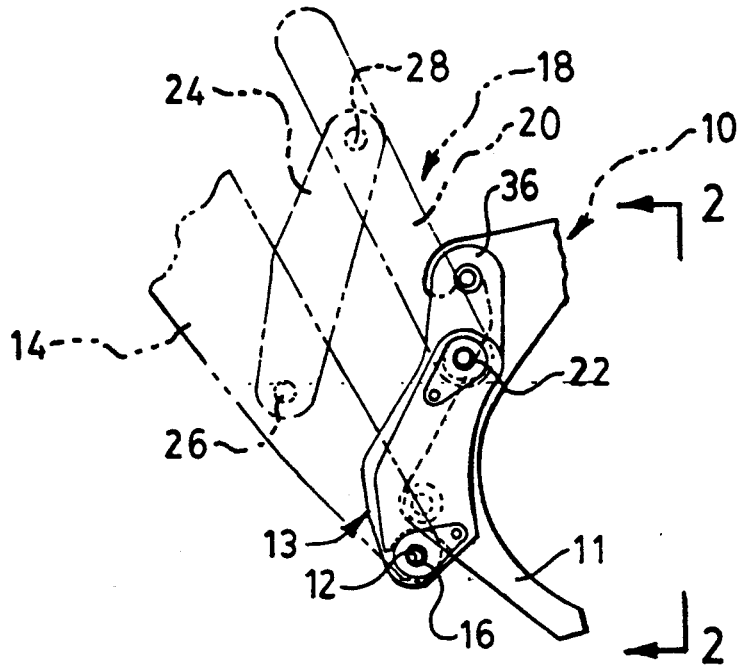
FIG. 1 is a diagrammatic side elevational view of a work implement and a mounting frame that is attached to the lift arms of a vehicle and discloses a coupling means that utilizes an indicating apparatus that embraces the principles of the present invention.
Figure 2:
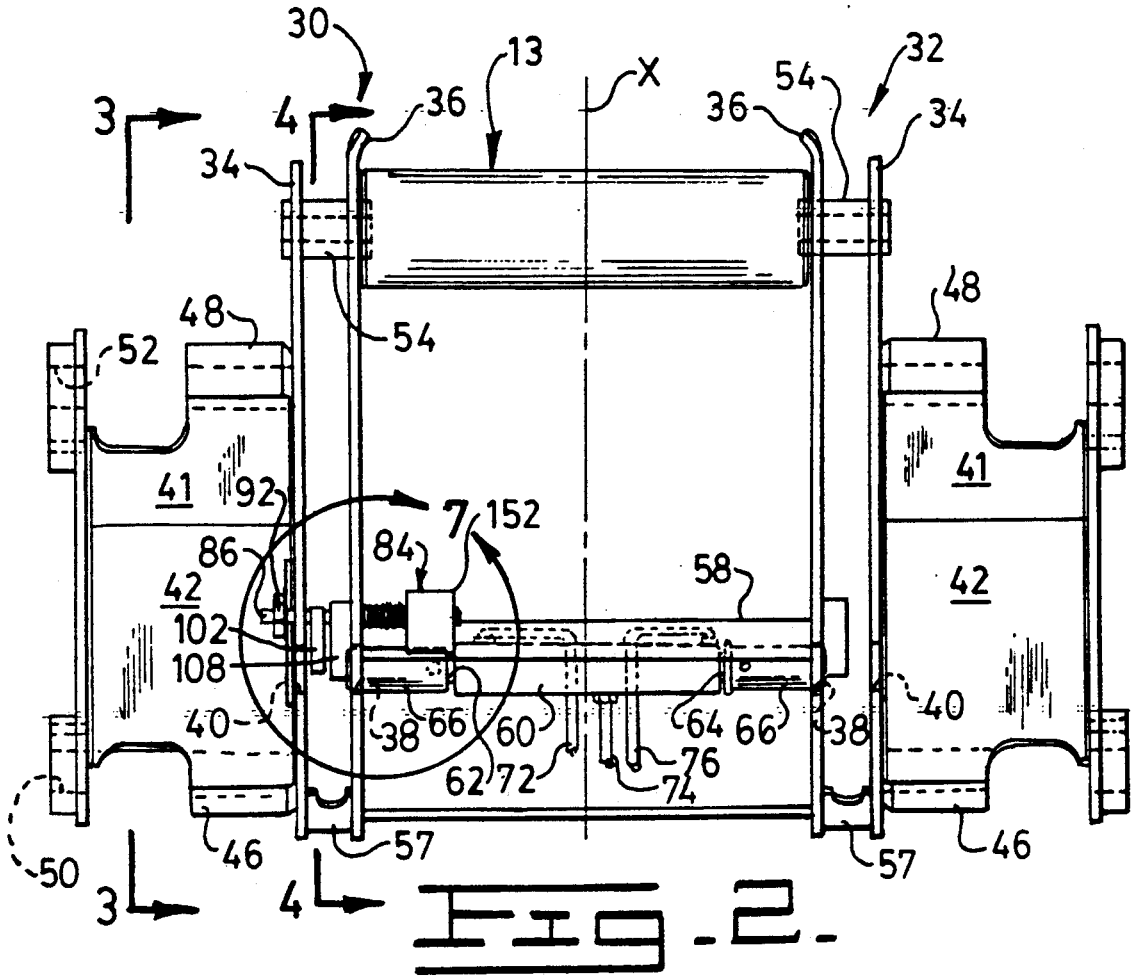
FIG. 2 is a diagrammatic view of the front of the mounting frame as viewed from lines 2—2 of FIG. 1.

Referring to the drawings, a first member in the form of a work implement 10 is shown that has a pair of spaced apart mounting flanges 11 (one shown), each of which defines a bore 12. The work member 10 is connected to a second support member or mounting frame 13. The mounting frame 13 is attached to a pair of lift arms 14 (one shown) of a vehicle (not shown) by a mounting pin 16. A tilt linkage assembly 18 is positioned between the mounting frame 12 and the lift arms 14. One link 20 of the linkage assembly is pivotally connected to the mounting frame 13 by a pin assembly 22 and a second link 24 is pivotally connected to the lift arms by another pin assembly 26. A hydraulic cylinder (not shown) is mounted between the lift arms and the connection point 28 of the two links 20 and 24. The cylinder provides a means by which the mounting frame 12 may be tilted in a fore and aft direction with respect to the lift arms 14.

The mounting frame 13 includes a pair of bracket assemblies 30 and 32 that are spaced from each other and positioned on opposite sides of a vertical centerline X of the mounting frame. Since the mounting frame is virtually identical about centerline X, only one side thereof will be described in detail with the reference numerals of like parts being applicable to both sides. The bracket assemblies 30 and 32 include a pair of plates 34 and 36 that are spaced from each other and extend vertically in parallel relation to each other. Each of the plates 34 and 36 have aligned bores 38 and 40 formed therein.

A plurality of plates 41, 42, 43, and 44 (FIG. 3) extend outwardly from the bracket assemblies to support a lower and upper tubular member 46 and 48. Each respective tubular member has a bore 50 and 52 formed therein that accept the mounting pins 16 and 22 and thereby serve as the mountings for the lift arms 14 and tilt linkage 18 respectively.

Figure 7:
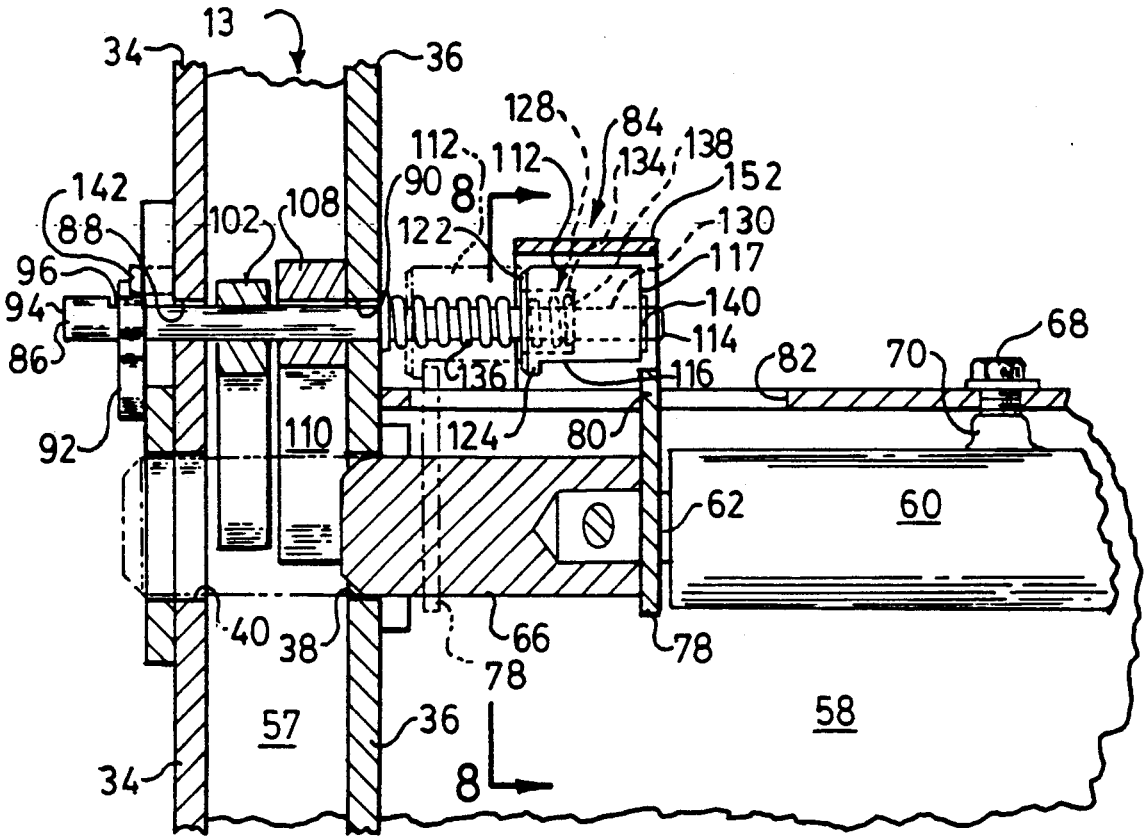
FIG. 7 is an enlarged view of an area indicated at 7 in FIG. 2.

An upper supporting tube 54 and a pair of lower plate members 56 and 5 extend laterally between plates 34 and 36 of the bracket assemblies 30 and 32 to provide structural rigidity to the mounting frame 13. A generally "C" shaped plate 58 (FIG. 8) extends between the bracket assemblies 30 and 32 and is attached by any suitable method such as welding. Housed within the "C" shaped plate 58 is a fluid actuated cylinder 60. The cylinder 60 is a double acting cylinder having a pair of cylinder rods 62 and 64 extending from its opposite ends. A mounting pin 66 is secured to the distal end of each cylinder rod 62 and 64. The cylinder 60 is affixed to the plate 58 by a plurality of fasteners 68, such as bolts, that are threadably received in a boss 70 that is centrally located on the body of the cylinder, as is shown best in FIGS. 7 and 8. The cylinder 60 is mounted such that the mounting pins 66 are positioned within the bore 38 in plate 36 of the bracket assemblies 30 and 32. The cylinder is extendable to position the mounting pins 66 within both bores 38 and 40 formed in the respective plates 34 and 36 and spanning the space therebetween. A plurality of conduits 72, 74, and 76 extend from the cylinder to a source of pressurized fluid (not shown) to cause the extension and retraction of the mounting pins.

A collar 78 is positioned on one or both cylinder rods 62 and 64 and defines a protrusion 80 that extends from the collar in a radial direction from the axis of the cylinder rods. The protrusion 80 extends through an axially oriented slot 82 in the plate 58 is moveable along the slot 82 as the mounting pin 66 is extended and retracted.

Figure 5:
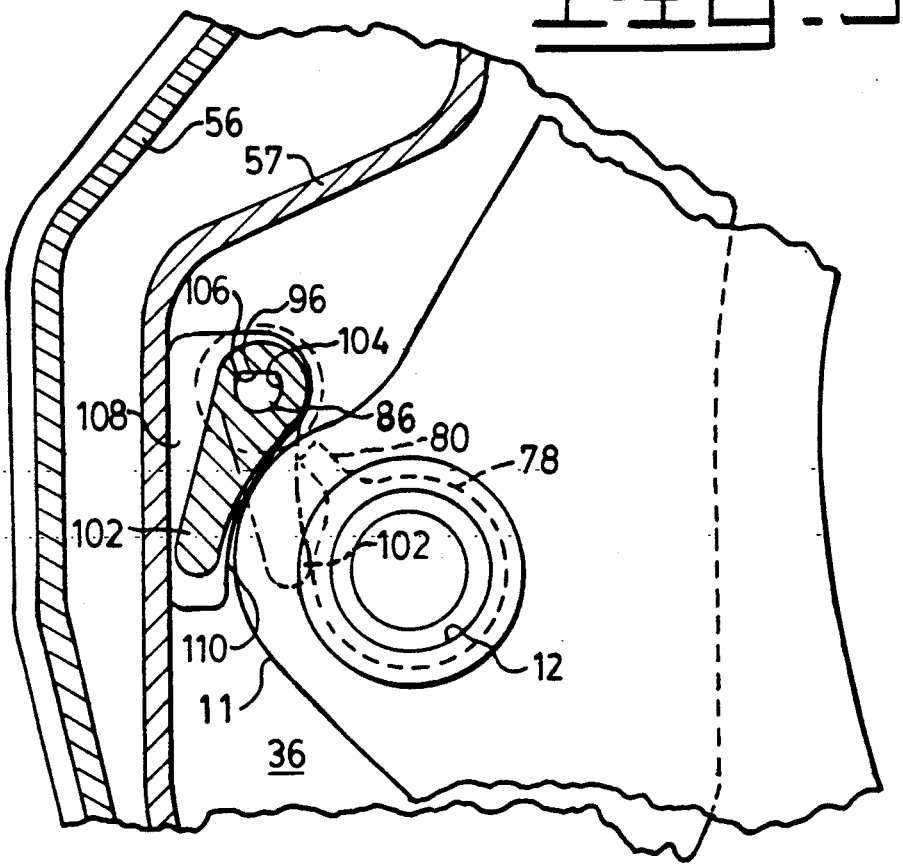
FIG. 5 is an enlarged, fragmentary cross-sectional view of the indicating apparatus shown in FIG. 4.

An indicating apparatus, shown generally at 84, is provided in the proximity of one or both mounting pins 66. In the present embodiment, only one indicating device 84 is disclosed and described in conjunction with bracket assembly 30. The indicating apparatus includes a shaft or rod 86 that extends through a pair of bores 88 and 90 in plate 34 and 36, respectively of the bracket assembly 30. Enough clearance is provided at the interface between the shaft and the bores 88 and 90 to permit relative rotation between the shaft and plate 34 and 36. A first lever 92 is mounted on the outermost or leftward end portion 94 of the shaft 86, as viewed in FIG. 7. The shaft is provided with a flat portion 96 that engages a similarly sized flat portion 98 formed on a bore 100 in the lever 92. This mounting secures the lever 92 on the shaft in a manner that will cause the lever and the shaft to rotate together. A second lever or contact member 102 is mounted on the shaft in a similar manner (FIG. 5). The lever 102 also has a bore 104 that defines a flat portion 106 that engages the flat portion 96 of the shaft 86 to provide rotation of both members. The second lever 102 is mounted inwardly of the first lever 92 and is positioned between plates 34 and 36. A contoured abutment plate or block 108 is mounted to the laterally extending reinforcement plate 57 of the bracket assembly 30. The abutment plate 108 is located between plates 34 and 36 and is adjacent the second lever 102 with a contoured surface 110 thereof facing forwardly.

Figure 8:
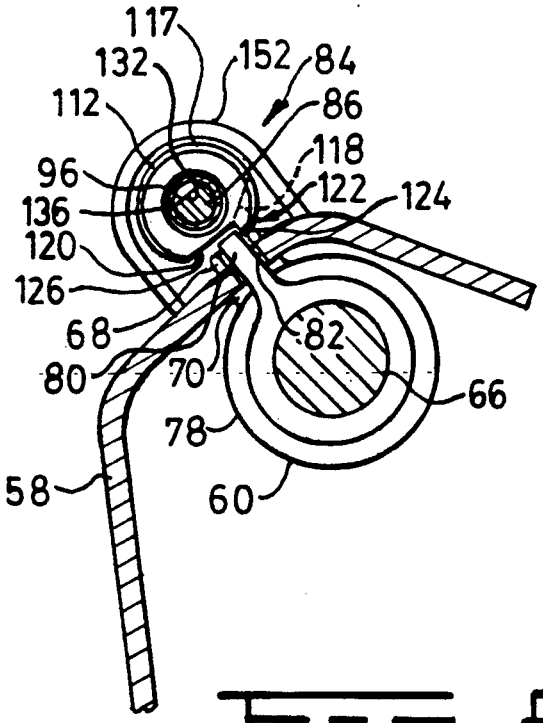
FIG. 8 is an enlarged, cross-sectional view of the indicating apparatus as viewed along lines 8—8 of FIG. 7.

A blocking member 112 is mounted on the inner most portion 114 of the shaft 86, inwardly of the bracket assembly 30. The blocking member 112 defines a body 117 that is generally cylindrical in configuration and defines a relieved portion 116 in the form of a pair of planar surfaces 118 and 120 that form a dihedral angle on a portion of the periphery of the cylindrical body 117. One of the planar surfaces 118 is terminated just short of the outermost or leftward end portion 122 of the blocking member 112 as viewed in FIG. 7, to form an extension 124 on the periphery thereof. The other planar surface 120 is continuous along the entire length of the cylindrical body 117 and combines with the peripheral extension 124 to define a notch or a relief 126 in the outer end portion 122 of the blocker member as viewed from an end view thereof as is best shown in FIG. 8. A stepped bore 128 extends axially along the centerline of the blocking member 112. A first portion 130 of the bore is slightly larger in diameter than that of the shaft 86 to allow the blocking member 112 to freely move axially along the shaft. The first portion 130 of the stepped bore 128 define a flat portion 132 that engages the flat portion 96 of the shaft 86 to prevent relative rotation between the two members. The second portion 134 of the stepped bore 128 has an enlarged diameter that is of sufficient size to accommodate the placement of a coil spring 136 about the shaft 86. The coil spring bears against the inner plate 36 of the bracket assembly 32 on one end and against a vertically facing end wall 138 formed between the portions 130 and 134 of the bore 128 on its opposite end. Being so positioned, the spring 136 biases the blocking member 112 against a pin or a stake 140 that extends through the shaft 86 to limit its inward, or rightward, movement as viewed in FIG. 7.

Figure 6:
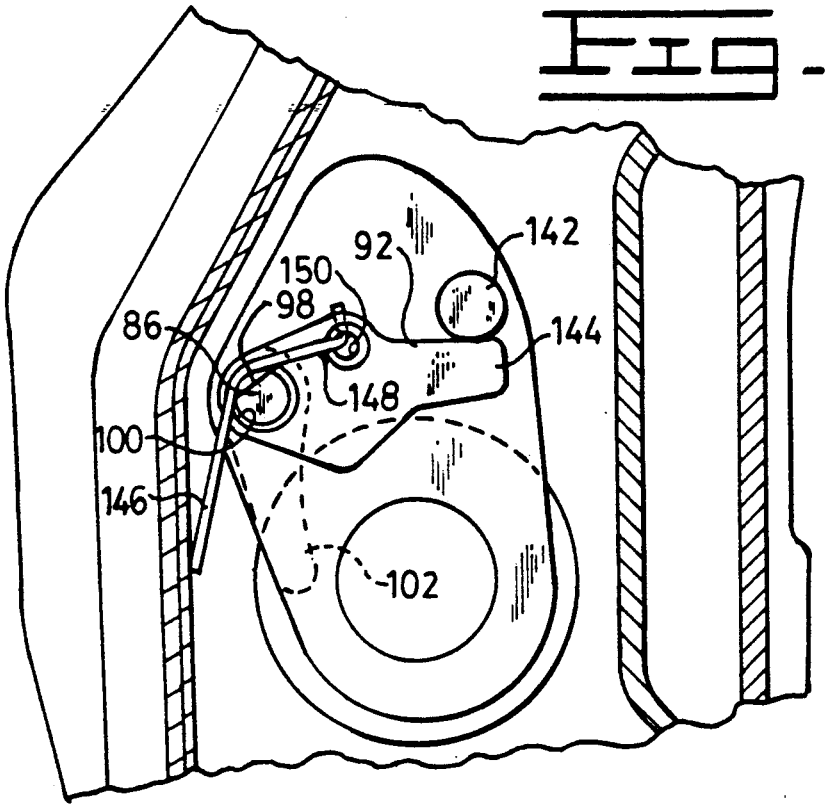
FIG. 6 is an enlarged, fragmentary cross-sectional view of the indicating apparatus as viewed in FIG. 3.

A stop member 142 in the form of a pin or dowel extends from plate 34 of the bracket assembly 30 in the proximity of a distal end 144 of the first lever 92. A torsion spring 146 is positioned about the shaft 86 and has one end 148 thereof extended through an opening 150 in the first lever 92. The torsion spring 146 serves to bias the first lever 92, the shaft 86, the second lever 102, and the blocking member 112 in a counter-clockwise direction as viewed in FIGS. 5 and 6.

A cover member 152, having a shape that is an inverted "U" is attached to the "C" shaped plate 58 that houses the mounting cylinder 60. The cover member straddles the slot 82 in the plate 58 in a location that will fully house the blocking member 112 when it assumes its innermost position.

Industrial Applicability

When performing a coupling operation, the mounting frame 13 is initially brought into contact with the work implement 10 by manipulation of the vehicle and implement controls. The mounting frame is positioned so that the flanges 11 of the work implement 10 are located between plates 34 and 36 of bracket assemblies 30 and 32. The bore 12 of the work implement 10 is placed in general registry with the bores 38 and 40 of the plate 36 and 34. The mounting frame 13 is advanced toward the implement to a point wherein the flange 11 of the work implement 10 engages the contoured abutment plate 108. Since in the illustrated embodiment, the contour of the flange substantially matches that of the abutment plate, the two components tend to "seat" together. As the flange 11 of the work implement 10 is approached by the mounting frame 13, contact between the flange and the second lever 102 is established. As the flange 11 continues to approach contact with the contoured abutment plate 108, continued movement of the second lever 102 causes the rotation of the shaft 86 in a clockwise direction as viewed in FIGS. 5 and 8. As this happens, the blocking member 112 is rotated to a position wherein the peripheral extension 124 blocks the axial movement of the protrusion 80 of the collar 78 along the slot 82 in plate 58. When the cylinder 60 is actuated by introduction of pressurized fluid to the central portion of the cylinder via conduit 74, the mounting pins 66, mounted on the cylinder rods 62 and 64 are moved outwardly. The mounting pins 66 in their extended position span the distance between the plate 34 and 36 of the bracket assemblies 30 and 32 and assume a position within the aligned bores 38, 40, and 12, of the plate 36 and 34 and the flange member 11, respectively to fasten the work implement to the mounting frame. In this position, the protrusion 80 of the collar 78 has moved outwardly. Due to the relationship between the peripheral extension 124 of the blocking member 112 and the protrusion 80 of the collar 78, the blocking member is carried outwardly with the movement of the mounting pins 66. In this position, the blocking member 112, which may be provided with highly visible indicia on its outer periphery 122, is moved from its position underneath the cover member 152, to a position that is visible to the vehicle operator.

If for any reason, mounting flange 11 of the work implement 10 does not register with the abutment plate 108, and the second lever 102 remains disengaged from the mounting flange, the shaft 86, and therefore the blocking member 112, will not be rotated. If the mounting pins 66 are extended with the blocking member 112 in this position, the protrusion 80 will be in alignment with the relief 126 defined in the periphery of the blocking member 112, thereby allowing the protrusion to move outwardly without contact. As a result, no indicator will be visible to the operator.

With an indicating apparatus of this type, the visibility of the blocking member 112 assures the operator that the mounting pins 66 have been properly positioned within the aligned bores 38, 40, and 12, and that a proper coupling has been obtained. Conversely, if the operator sees no indicator at all, he knows that a proper coupling has not been obtained and he must make another attempt. By utilizing such a device, the guesswork previously involved in coupling the many work implements to a vehicle is totally alleviated.

Other aspects, objects, and advantages of this invention can be obtained from a study of the drawings, the disclosure and the appended claims.

I claim:

1. An apparatus for indicating the coupled condition between a first and second member, said first member having an opening formed therein and the second member having a mounting pin moveable into said opening to couple the respective members, comprising:

a plate having an opening formed therein and being mounted to the second member;

a shaft positioned in the opening formed in the plate;

a lever mounted on the shaft, said lever and said shaft being rotatable with respect to the plate member to establish contact between the first and second members only when said members are in a position sufficient for being coupled to one another; and means for indicating the movement of the pin into the opening of the first member, said indicating means being operable only when contact between the first and second members has been established.

2. The indicating apparatus as set forth in claim 1 wherein the contacting means is mounted to the second member.

3. The indicating apparatus as set forth in claim 1 wherein the indicating means includes a blocking member having a peripheral extension and being mounted on the shaft for rotation therewith.

4. The indicating apparatus as set forth in claim 3 wherein the mounting pin includes a protrusion that extends radially therefrom to a position wherein it will contact the peripheral extension of the blocking member upon movement of the pin towards engagement with the first member and only when the first member is engaged with the contact means, said blocking member being carried by the movement of the pin from a first position wherein the blocking member is obscured from sight to a second position wherein the blocking means is visible.

5. The indicating apparatus as set forth in claim 4 wherein a relieved portion is formed in the periphery of the blocking member and is oriented with respect to the protrusion such that no contact between the protrusion and the blocking member will occur in absence of contact between the first member and the contact means.

6. The indicating apparatus as set forth in claim 5 wherein a biasing means is positioned between the second member and the blocking member to bias the blocking member to its first position in absence of contact with the protrusion.

7. An apparatus for indicating the coupling of a work implement to a support member, comprising:

a mounting flange defined by the work implement having at least one bore defined therethrough;

means positioned on the support member for receiving the mounting flange of the work implement, said receiving means defining at least one bore that is alignable with the bore in the mounting flange;

means for fastening the work implement to the support member, said fastening means including a pin member having a protrusion extending radially therefrom and being moveable from a first position wherein the fastening means is removed from the aligned bores in the work implement and support member to a second position wherein the fastening means is positioned within the respective bores;

means positioned between the support member and the work implement for contacting the mounting flange of the work implement only when it is in a position to receive the fastening means; and means for indicating movement of the fastening means to the second position, said indicating means being operable only when the work implement is engaged with the contacting means.

8. The indicating apparatus as set forth in claim 7 wherein the contacting means further includes:

a plate attached to the support member having an abutment portion formed thereon;

a lever rotatably mounted to the plate by a shaft and being moveable between a first position wherein the lever is rotated away from the abutment portion and a second position wherein the lever is rotated toward said abutment portion through contact with the mounting flange of the work implement.

9. The indicating apparatus as set forth in claim 8 wherein the indicating means includes a generally cylindrical blocking member mounted on the shaft that mounts the lever and being rotatable therewith in response to movement of the lever between its first and second positions.

10. The indicating apparatus as set forth in claim 9 wherein the blocking member defines a peripheral extension that is engageable with the protrusion defined by the pin member when the pin member is moved towards its second position and the lever of the contact means is in its second position.

11. The indicating apparatus as set forth in claim 10 wherein the blocking member further defines a relieved portion on the peripheral extension, said relieved portion being alignable with the protrusion of the pin member to prevent contact between the blocking member and the protrusion when the pin is moved toward its second position and the lever of the contact member is in its first position.

12. The indicating apparatus as set forth in claim 7 wherein the indicating means is moveable between a first visually obscured position and a second visible position in response to the engagement between the contacting means and the mounting flange of the work implement and movement of the fastening means to its second position.

13. In a vehicle having a support member having an opening, a work implement having a mounting flange formed thereon and an opening extending therethrough that is alignable with the opening of the support member, and a pin member that is moveable between a first position wherein the pin is removed from the aligned openings and a second position wherein the pin is positioned within said aligned openings to couple the work implement to the support member, an apparatus for indicating the coupled condition between the support member and the work implement, comprising:

a bracket assembly mounted to the support member having a bore defined therethrough;

a shaft rotatably positioned within the bore;

a lever fixed to the shaft and being rotatable with respect to the bracket assembly from a first position to a second position as a result of contact with the mounting flange of the work member; and a blocking member mounted on the shaft for rotation therewith and being engageable with the pin member as the pin member is moved toward its second position to move the blocking member from a first visually obscured position to a second visible position only when the lever is in its second position.

14. The indicating apparatus as set forth in claim 13 wherein the pin member includes a protrusion that extends radially therefrom.

15. The indicating apparatus as set forth in claim 14 wherein the blocking member includes a peripheral extension that engages the protrusion of the pin member as it moves toward its second position when the lever has been rotated to its second position through contact with the mounting flange of the work implement.

16. The indicating apparatus as set forth in claim 15 wherein a relieved portion is formed on said peripheral extension and is alignable with the protrusion of the pin member in absence of contact between the mounting flange of the work element and the lever to avoid engagement with the pin as it moves towards its second position.

17. The indicating apparatus as set forth claim 13 wherein the support member includes a frame having a pair of bracket assemblies defined on opposing end portions thereof, each bracket assembly having a pair of spaced plates having an opening formed therein, said bracket assemblies being so constructed and arranged so as to receive the mounting flange of the work implement between said plates with the respective openings in alignment with one another.

18. The indicating apparatus as set forth in claim 17 wherein a fluid actuated cylinder is housed between the bracket assemblies, said cylinder having a pair of cylinder rods extending therefrom and being adapted for mounting a pin on each of said cylinder rods, said cylinder being positioned in alignment with the respective openings and being operable to move the pins between their first and second positions.

* * * * *